United States Patent [19]

Suzuki

[11] Patent Number: 5,064,133

[45] Date of Patent: Nov. 12, 1991

[54] DRIVING FORCE TRANSMITTING APPARATUS

[75] Inventor: Tsuyoshi Suzuki, Nagoya, Japan

[73] Assignee: Brother Kogyo Kabushiki Kaisha, Nagoya, Japan

[21] Appl. No.: 470,240

[22] Filed: Jan. 25, 1990

[30] Foreign Application Priority Data

Jan. 31, 1989 [JP] Japan ..... 1-11339[U]

[51] Int. Cl.[5] ..... B65H 18/00; F16D 7/02

[52] U.S. Cl. ..... 242/67.3 R; 464/30

[58] Field of Search ..... 242/67.3 R, 67.1 R, 242/67.2; 464/55, 61, 69; 469/30, 42; 192/80, 56 C

[56] References Cited

U.S. PATENT DOCUMENTS

| | | | |
|---|---|---|---|
| 1,065,736 | 6/1913 | Simmons | 464/55 |
| 2,531,558 | 1/1950 | Debrie | 464/55 X |
| 3,034,241 | 5/1962 | Kossor et al. | 242/67.3 R |
| 3,281,090 | 10/1966 | Baranowski, Jr. | 242/67.3 R |
| 4,095,485 | 6/1978 | Hiersig | 464/17 X |
| 4,239,375 | 1/1980 | Eisbein et al. | 242/67.3 R X |
| 4,300,363 | 11/1981 | Mathues | 464/55 |
| 4,806,982 | 2/1989 | Yamamoto et al. . | |
| 4,827,356 | 5/1989 | Yamamoto et al. . | |
| 4,847,661 | 7/1989 | Ueda et al. . | |

FOREIGN PATENT DOCUMENTS

| | | | |
|---|---|---|---|
| 506623 | 3/1953 | Belgium | 464/61 |
| 0088322 | 4/1988 | Japan | 464/61 |
| 362956 | 12/1972 | U.S.S.R. | 464/61 |

*Primary Examiner*—Daniel P. Stodala
*Assistant Examiner*—John P. Darling
*Attorney, Agent, or Firm*—Oliff & Berridge

[57] ABSTRACT

A driving force transmitting apparaus having a rotation drum which is driven by a drive shaft and which is rotatable relative to a driven shaft and a rotation member which is fixed on the driven shaft and transmit driving force from the drive shaft to the driven shaft is disclosed. The rotated drum has an outer peripheral surface contacting a friction pad attached to the rotation member. Driving force is transmitted from the drive shaft to the driven shaft through the drum, the friction pad and the rotation member.

11 Claims, 4 Drawing Sheets

DRIVING FORCE TRANSMITTING APPARATUS

BACKGROUND OF THE INVENTION

1. Field of the Invention

This invention relates to a driving force transmitting apparatus, and in particular to a driving force transmitting apparatus which is used in a sheet winding apparatus of a copying machine.

2. Description of Related Art

Generally, driving force transmitting apparatus, such as clutches, etc. are used in many apparatus. Such driving force transmitting apparatus transmit rotational torque adjusted to a driven mechanism. For example, a driving force transmitting apparatus as described above is used in a color copying machine in which a microcapsule carrying sheet is used in U.S. Pat. No. 4,806,982, U.S. Pat. No. 4,827,356 and U.S. Pat. No. 4,847,661. In such a copying machine, a continuous microcapsule carrying sheet wound in a cartridge is provided and then wound onto a winding shaft (or take-up shaft) after its use. While being unwound, a latent image corresponding to an original manuscript is formed on the microcapsule carrying sheet by exposing a part of the microcapsule carrying sheet to a light image corresponding to the image of the manuscript. Further, the exposed part of the microcapsule sheet is pressed with a developer sheet carried from a developer sheet cassette in a pressure developing unit and a color image corresponding to the latent image is formed on the developer sheet. In this manner, color copying is completed.

In the above copying process, if the microcapsule sheet is overreleased, the latent image of the manuscript is often distorted as formed on the microcapsule sheet. This leads to copying of distorted incorrect images on the developer sheet. Therefore, in the above conventional copying machine, it is necessary to give a high tension to the microcapsule carrying sheet by rotating the winding shaft with high torque in order to obtain the correct latent image of the manuscript.

As shown in detail in FIG. 6, a first plate 43*a* is fixed to an end of a winding shaft 41 around which the microcapsule sheet is wound (not shown) and a second plate 43*b* for receiving driving force is connected to the first plate 43*a* through a compressing spring 42 located therebetween. A friction pad 44 is fixed to the second plate 43*b*. A third plate 46 for transmitting driving force is fixed to an end of a driving shaft 45 which is driven by a motor. Another friction pad 47 is fixed to the third plate 46 so as to contact with the friction pad 44. By this construction, driving force from the driving shaft 45 is transmitted to the winding shaft 41 through frictional power caused between the second and the third plates. As a result, the microcapsule sheet is wound by rotation of the winding shaft 41.

In the above described conventional driving force transmitting apparatus, in order to transmit driving force with high torque it is necessary: (1) to enlarge sizes of both the second and third plates, resulting in an increase of the frictional area between both the pads 44, 47; (2) to strengthen the compressing force of the compressing spring 42 disposed between the first and second plates; or (3) to form the pads 44, 47 from materials which have a large frictional coefficient. However, the above methods (1), (2) and (3) have the following defects: the first method (1) requires a large space due to the enlarged sizes of the second and third plates and thus prevents the manufacture of a compact copying machine; the second method (2) is difficult to assemble and an undesired influence is produced on the mechanical strength of the apparatus due to the strengthened compressing force of the compressing springs 42; and the third method (3) is not economical because the life of the pads 44 and 47 is decreased due to the material having the large frictional coefficient causing sand burning of the pads 44, 47.

SUMMARY OF THE INVENTION

It is therefore an object of the present invention to eliminate the above disadvantages of the prior art driving force transmitting apparatus.

Another object of the present invention is to provide a novel driving force transmitting apparatus which makes it possible to provide a compact apparatus without requiring a large space for enclosing the apparatus therein.

Still another object of the present invention is to provide a low-cost driving force transmitting apparatus with large mechanical strength and a long available life, which is much easier to assemble than previous force transmitting apparatus.

The above objects are achieved according to the present invention which includes: a drive shaft, a driven shaft, a driving force transmitting means disposed between said drive shaft and said driven shaft for transmitting driving force provided by said drive shaft; wherein, said driving force transmitting means includes: a rotation drum with an outer peripheral surface rotated by the driving force from said drive shaft; a rotation member for transmitting rotation of said rotation drum to said driven shaft; and a friction means attached to said rotation member, said friction means contacting said outer peripheral surface of said rotation drum.

In the above construction, when said rotation drum is rotated according to rotation of said drive shaft, driving force due to rotation of said drive shaft, is transmitted to said driven shaft through the contact made between the outer peripheral surface of said rotation drum and the friction means which is attached to said rotation member. The frictional force caused between said outer peripheral surface and said friction means enables the driving force to be transmitted to the driven shaft.

The above and other objects, features and advantages of the present invention will become more apparent from the following description when taken in conjunction with the accompanying drawings in which a preferred embodiment of the present invention is shown by way of illustrative example.

BRIEF DESCRIPTION OF THE DRAWINGS

In the accompanying drawings.

DETAILED DESCRIPTION OF THE PREFERRED EMBODIMENT

Figure 1:
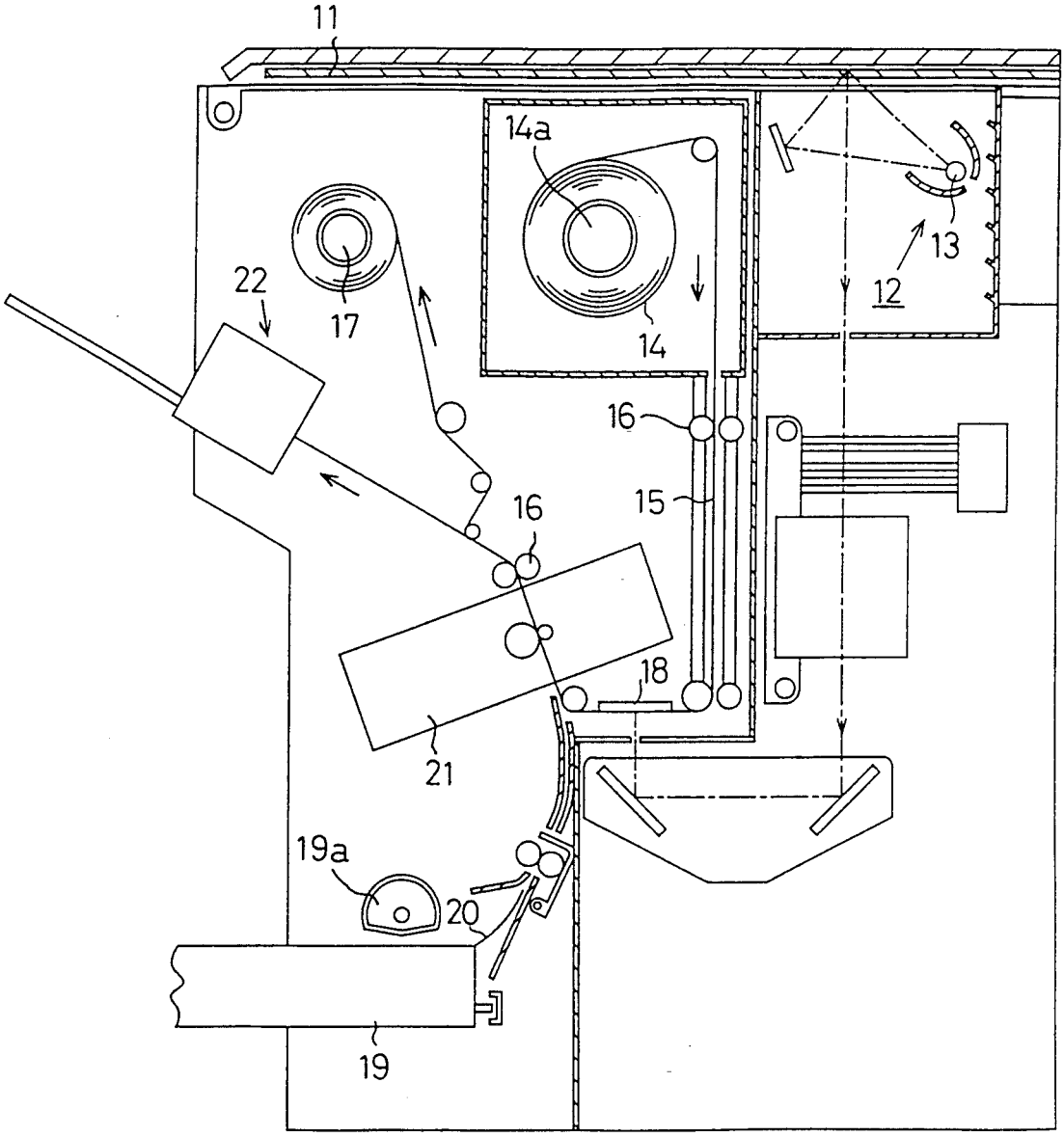
FIG. 1 is a schematic vertical sectional view of a copying machine having a driving force transmitting apparatus according to the present invention.

A preferred embodiment of the present invention embodied in a winding mechanism of a copying machine will be described. FIG. 1 shows a front sectional view of a color copying machine incorporating a driving force transmitting apparatus according to the present invention. In FIG. 1, a manuscript glass plate 11 is provided at an upper position of the copying machine and is movable to the rightward end in FIG. 1. A halogen lamp 13 as a light source 12 is lighted when a leftward end of an original manuscript on the glass plate 11 is positioned against the halogen lamp 13 after the manuscript glass plate 11 is moved to the rightward end of the copying machine. Irradiation of light to the original manuscript by the halogen lamp 13 is conducted while the manuscript glass plate 11 is moved to the leftward end. When the glass plate 11 is moved in the leftward direction while irradiating, a continuous microcapsule carrying sheet 15 wound around a cartridge shaft 14*a* in a cartridge 14 is drawn from the cartridge 14 by means of a plurality of feed rollers 16, and is consequently wound around a winding shaft (or take-up shaft) 17. While the microcapsule carrying sheet 15 is being drawn from cartridge 14, a part of the sheet 15 which is passed under the surface of an exposing stand 18 is exposed and a latent image according to the original manuscript is formed on the microcapsule carrying sheet 15.

A cassette 19 accommodating a plurality of cut-sheet type developing sheets 20 stacked therein is disposed at a position to the left and under exposing stand 18. Developing sheets 20 are sent toward a pressure developing unit 21, one by one, through a semicircular roller 19*a*. The exposed portion of the microcapsule carrying sheet 15 and a developing sheet 20 are pressed against each other in the pressure developing unit 21, resulting in a color image being formed on the developing sheet 20. Thereafter, the developing sheet 20 having the color image formed thereon is fed into a heating unit 22 for fixing the color image by heat emitted from a heater (not shown) in the heating unit 22 After fixing of the color image onto developer sheet 20, the developing sheet 20 is fed out of the copying machine.

Figure 3:
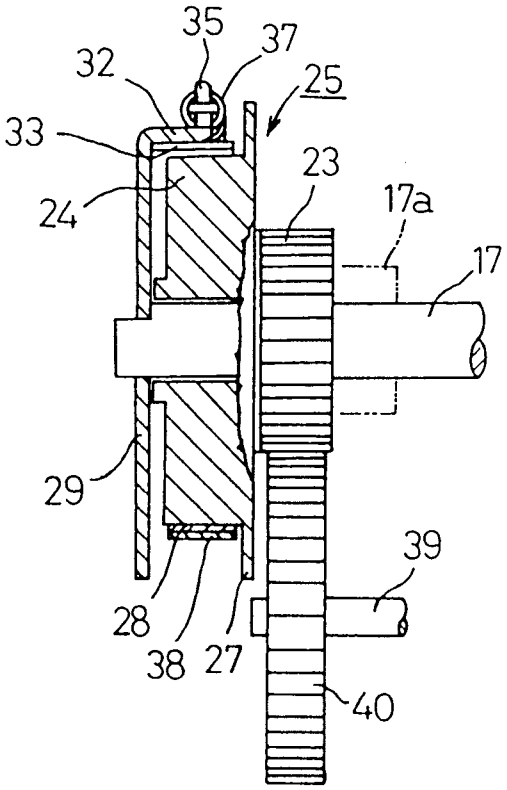
FIG. 3 is a sectional view of the driving force transmitting apparatus when sectioned along a line III—III of FIG. 2.

The driving force transmitting apparatus embodied in a winding mechanism for the microcapsule carrying sheet 15 will be described based on FIG. 2 and FIG. 3. As shown in FIG. 3, a rotation drum 25 including a gear 23 and a drum member 24, both of which are integrally formed into one body, is disposed on a winding shaft 17 so as to freely rotate relative to the winding shaft 17. A diameter of the gear 23 is set smaller than that of the drum member 24. The rotation drum 25 is prevented from moving in the direction along the winding shaft 17 by a bearing 17*a* fixed to the shaft. In FIG. 3, a right side portion of the winding shaft 17 from the gear 23 is for convenience referred to as the "winding side", and, a left side portion of the shaft 17 relative to the gear 23 is referred to as the "transmitting side". A flange 27 is integrally formed with the drum member 24 of the rotation drum 25 at a right end side thereof, a diameter of the flange 27 being larger than that of the drum member 24.

Figure 2:
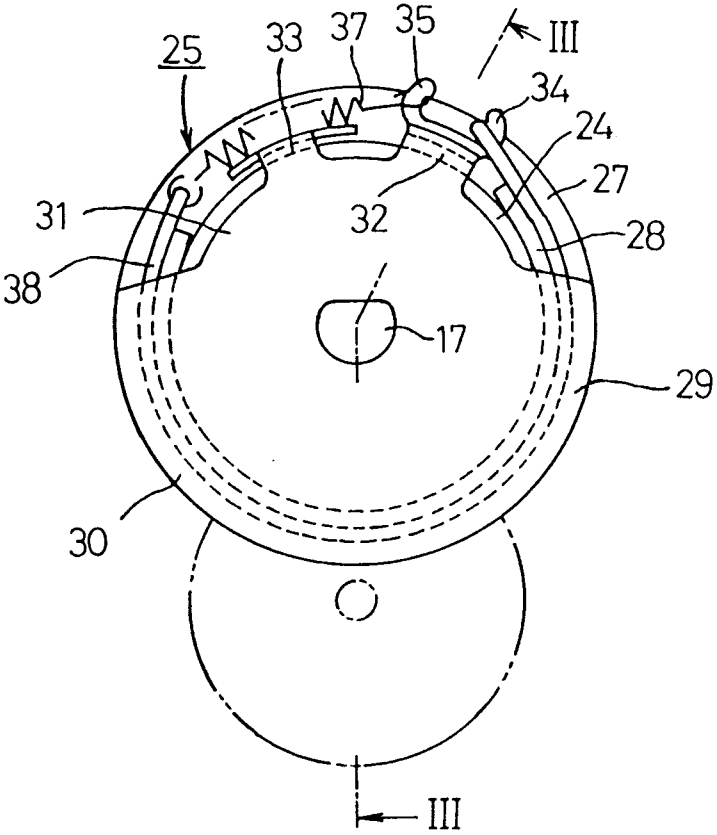
FIG. 2 is a front view of the driving force transmitting apparatus according to the present invention.

As shown in FIG. 2, the left end of the winding shaft 17 protrudes out of the drum member 24 of the rotation drum 25. The left end of winding shaft 17 is partially cut away and its end shape is substantially formed like a "D" character as viewed from the direction of the left end side of the shaft 17. A disc like rotation plate 29 is fixed at the "D" shaped end of the shaft 17. Rotation plate 29 has a large diameter portion 30 and a small diameter portion 31. The large diameter portion 30 has a diameter the same as that of the flange 27, and the small diameter portion 31 has a diameter slightly smaller than that of the drum member 24. The rotation plate 29 includes a hooking protrusion 32 for hooking a belt, etc., explained hereinafter and a guiding protrusion 33 for guiding a coil spring 37 explained hereinafter. Both protrusions 32, 33 protrude from a circumference of the small diameter portion 31 of rotation plate 29. Both protrusions 32, 33 are folded at right angles to the circumference surface of the rotation plate 29 toward the winding side such that the protrusions 32, 33 are close to an outer peripheral surface of the drum member 24. Formed at a top of the protrusion 32 are two hooking members 34, 35 which protrude outwardly from the circumference of the small diameter portion 31. One hooking member 34 is for hooking a pressure belt 38 and the other hooking member 35 is for hooking coil spring 37. Tops of the two hooking members 34, 35 face each other. The coil spring 37, one end of which is hooked by the hooking member 35, is drawn in a counterclockwise direction along the guiding protrusion 33. The pressure belt 38, one end of which is hooked by the hooking member 34, is drawn in a clockwise direction. A friction pad 28 is adhered on an inner surface of the pressure belt 38 and is drawn in a clockwise direction so as to be pressed against the outer peripheral surface of the drum member 24. The other ends of the pressure belt 38 and the coil spring 37 are connected with each other.

By this construction, the friction pad 28 adhered to the pressure belt 38 is always strongly pressed against the outer peripheral surface of the drum member 24. Numeral 39 is a driving shaft driven by a motor, not shown. A driving gear 40 fixed on the driving shaft 39 is meshed with the gear 23 of the rotation drum 25. When rotational force of the driving shaft 39 caused by the motor is transmitted to the rotation drum 25 through the gears 40, 23, the rotation plate 29 is rotated according to the rotational torque of the rotational drum 25 through frictional force caused between the outer peripheral surface of the rotation member 24 and the friction pad 28. Thus, the winding shaft 17 is rotated according to rotation of the rotation plate 29. As a consequence, rotational torque is correctly transmitted to the winding shaft 17, and therefore, the microcapsule carrying sheet 15 is wound on the winding shaft 17 by winding torque in the driving shaft 39 caused by driving the motor. Since the microcapsule carrying sheet 15 is tensioned with a predetermined correct tension without releasing thereof, a correct latent image is formed on the microcapsule carrying sheet 15.

As explained in detail, according to the preferred embodiment, transmission of driving force from the driving shaft 39 to the winding shaft 17 is achieved by meshing between the gears 23, 40 and pressing the friction pad 28 of the pressure belt 38 against the rotation drum 24, i.e., by the cylindrical rotation transmitting members 24, 29. According to the present invention, sufficient contact area between the outer peripheral surface of the drum member 24 and the friction pad 28 for transmitting a driving force can be obtained even in a relatively small space. Rotational torque of the driving shaft 39 is correctly transmitted to the winding shaft 17 without requiring a strengthened coil spring 37 or high friction coefficient material for the friction pad 28. Also a large space in the copying machine for transmitting driving force is not required, as in the conventional apparatus.

Furthermore, the winding torque increases as the winding diameter of the winding shaft 17 increases due to winding of the microcapsule carrying sheet 15 around shaft 17. As more of the sheet 15 is wound around shaft 17, the tension of the microcapsule carrying sheet 15 increases. As a result, an increasing rewinding force in a direction opposite to the rotational direction of the winding shaft 17, i.e., deterrent force deterring rotation of the shaft 17, acts on the winding shaft 17. However, the microcapsule carrying sheet 15 is not overtensioned because the coil spring 37 extends allowing the outer peripheral surface of drum member 24 to slide against friction pad 28. This limits the amount of tension which can be created in the microcapsule carrying sheet 15.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description. All changes which come within the meaning and range of equivalency of the claims are therefore intended to be embraced therein.

Figure 4:
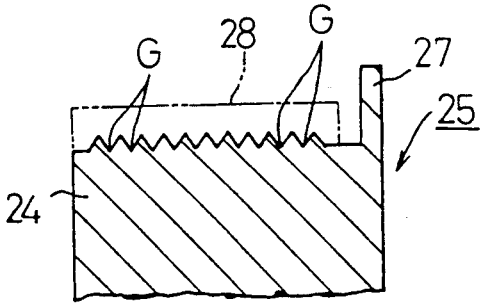
FIG. 4 is a fragmentary sectional view of another embodiment of a rotation drum.
Figure 5:
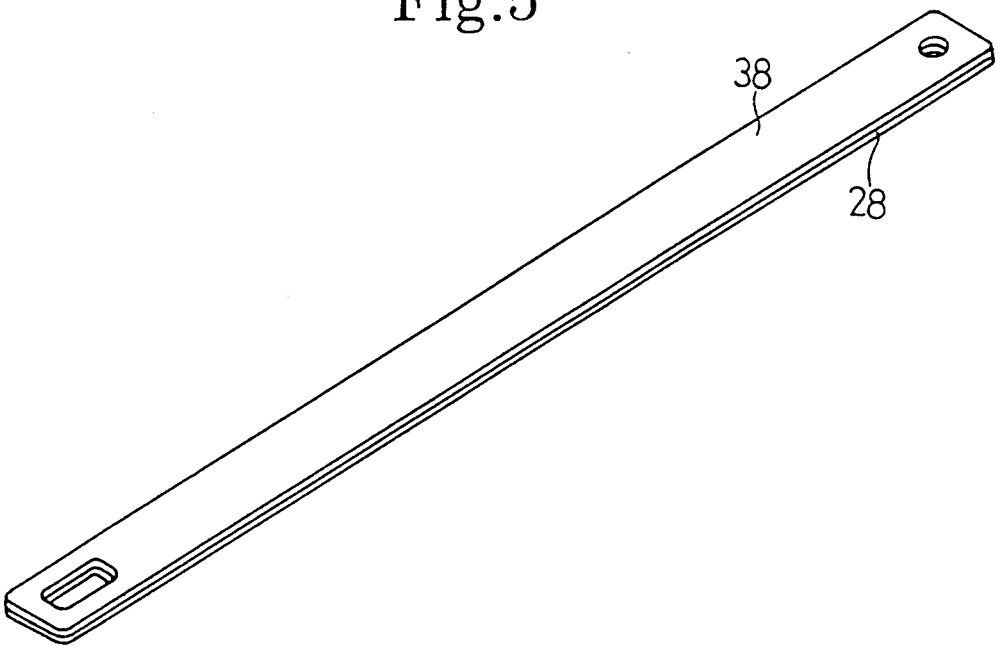
FIG. 5 is a perspective view of another process for producing a pressure belt and a friction pad.
Figure 6:
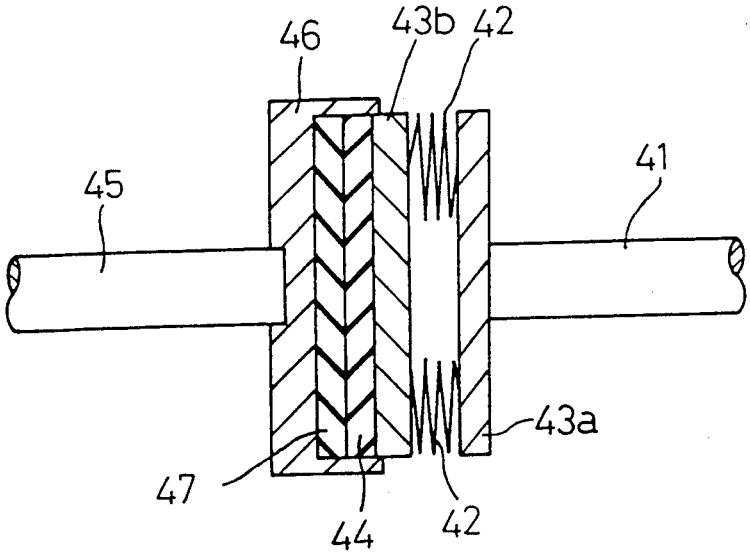
Fig.6 PRIOR ART
FIG. 6 is a sectional view of a driving force transmitting apparatus in a conventional apparatus.

For example, the presently illustrated embodiment can be changed as follows. As shown in FIG. 4, a plurality of grooves G may be formed on the outer peripheral surface of the drum member 24 of the rotation drum 25. Due to the grooves G, contact pressure caused between the friction pad 28 and the rotation member 24 may become higher and the followability of the winding shaft 17 at the beginning of rotation of the driving shaft 39 may become better. As shown in FIG. 5, the friction pad 28 and the pressure belt 38 can be produced by adhering the friction pad 28 composed of felt to the pressure belt 38 and thereafter, by being stamped out into a predetermined shape. With this method of production, the production cost of the friction pad 28 and the pressure belt 38 can be lowered In this modification, although two openings for being hooked at the hooking member 34 and the one end of the coil spring 37 are formed on both ends of the friction pad 28, there is no problem in producing frictional torque since the above two openings are formed at positions which do not contact the outer peripheral surface of the drum member 24. Further, in the above embodiment, although the rotation drum 25 is disposed on the winding shaft 17 and the gear 40 is fixed on the driving gear 39, it is understood that the rotation drum 25 may be disposed on the driving shaft 39 so as to freely rotate thereon and the gear 40 may be fixed on the winding shaft 17.

What is claimed is:

1. A copy machine which utilizes a continuous sheet for making an image of a manuscript on a copy sheet comprising:

means for supplying and taking-up a continuous sheet, said means including a supplying shaft and a take-up shaft;

means for winding the continuous sheet about said take-up shaft, said means for winding being disposed on said take-up shaft and comprising:

a drive shaft;

means, disposed between said drive shaft and said take-up shaft, for transmitting driving force caused by said drive shaft to said take-up shaft;

wherein said means for transmitting driving force includes:

a rotation drum having an outer peripheral surface rotated by driving force from said drive shaft;

a rotation member for transmitting rotation of said rotation drum to said take-up shaft, first and second fasteners protruding from a peripheral surface of said rotation member;

an elastic member having first and second ends;

a friction pad having a predetermined frictional coefficient and elastically contacting said outer peripheral surface of said rotation drum through said elastic member; and a belt for forcing said friction pad into contact with said outer peripheral surface of said rotation drum, said belt having an opening formed at each end thereof, one of said two openings being attached to said first fastener, the other of said two openings being attached to said first end of said elastic member, said second end of said elastic member being attached to said second fastener, said friction pad being located between said belt and said outer peripheral surface of said rotation drum; wherein said belt, said elastic member, and said friction pad rotate with rotation of said rotation member.

2. A driving force transmitting apparatus for attachment between a drive member and a driven member comprising:

a rotation drum having an outer peripheral surface, said rotation drum including means for engaging a drive member;

a rotation member including means for engaging a driven member, first and second fasteners protruding from a peripheral surface of said rotation member;

an elastic member having first and second ends;

a friction pad having a predetermined frictional coefficient and elastically contacting said outer peripheral surface of said rotation drum through said elastic member; and a belt for forcing said friction pad into contact with said outer peripheral surface of said rotation drum, said belt having an opening formed at each end thereof, one of said two openings being attached to said first fastener, the other of said two openings being attached to said first end of said elastic member, said second end of said elastic member being attached to said second fastener, said friction pad being located between said belt and said outer peripheral surface of said rotation drum; wherein said belt, said elastic member, and said friction pad rotate with rotation of said rotation member.

3. The apparatus according to claim 2, wherein said elastic member is a spring member.

4. The driving force transmitting apparatus according to claim 2 further comprising: a guide portion protruded from said peripheral surface of said rotation member, and wherein said elastic member is guided along said guide portion.

5. The driving force transmitting apparatus according to claim 2 wherein a plurality of grooves are formed on said outer peripheral surface of said rotation drum.

6. A driving force transmitting apparatus comprising:

a drive shaft;

a driven shaft;

means, disposed between said drive shaft and said driven shaft, for transmitting driving force caused by said drive shaft to said driven shaft, said means for transmitting driving force including:

a rotation drum having an outer peripheral surface rotated by driving force from said drive shaft;

a rotation member for transmitting rotation of said rotation drum to said driven shaft, first and second fasteners protruding from a peripheral surface of said rotation member;

an elastic member having first and second ends;

a friction pad having a predetermined frictional coefficient and elastically contacting said outer peripheral surface of said rotation drum through said elastic member; and a belt for forcing said friction pad into contact with said outer peripheral surface of said rotation drum, said belt having an opening formed at each end thereof, one of said two openings being attached to said first fastener, the other of said two openings being attached to said first end of said elastic member, said second end of said elastic member being attached to said second fastener, said friction pad being located between said belt and said outer peripheral surface of said rotation drum; wherein said belt, said elastic member, and said friction pad rotate with rotation of said rotation member.

7. The driving force transmitting apparatus according to claim 6, wherein said elastic member is a spring member.

8. The driving force transmitting apparatus according to claim 6, wherein said rotation drum is disposed on said driven shaft so as to be rotatable relative to said driven shaft, and wherein said rotation member is fixed on said driven shaft so as to be rotatable with said driven shaft.

9. The driving force transmitting apparatus according to claim 6, further comprising: a guide portion protruded from said peripheral surface of said rotation member, and wherein said elastic member is guided along said guide portion.

10. The driving force transmitting apparatus according to claim 6, wherein a plurality of grooves are formed on said outer peripheral surface of said rotation drum.

11. The driving force transmitting apparatus according to claim 6, further comprising a sheet winding mechanism connected to said driven shaft.

* * * * *